United States Patent [19]

Evans

[11] 3,997,029

[45] Dec. 14, 1976

[54] CARRIAGE HOISTING ARRANGEMENT FOR A LIFT TRUCK

[75] Inventor: Dafydd W. Evans, Euclid, Ohio

[73] Assignee: Towmotor Corporation, Mentor, Ohio

[22] Filed: Sept. 8, 1975

[21] Appl. No.: 611,296

[52] U.S. Cl. ..... 187/9 R; 214/674; 214/DIG. 7; 187/9 E

[51] Int. Cl.[2] ..... B66F 9/06

[58] Field of Search ..... 187/9 R, 9 E; 214/670–674, DIG. 7; 254/189

[56] References Cited

UNITED STATES PATENTS

| | | | |
|---|---|---|---|
| 1,912,816 | 6/1933 | Anthony | 214/672 |
| 2,670,811 | 3/1954 | Shaffer | 187/9 E |
| 2,877,868 | 3/1959 | Gunning et al. | 187/9 E |
| 2,925,888 | 2/1960 | Kagel | 187/9 R |
| 3,203,568 | 8/1965 | Quayle | 187/9 R |
| 3,266,599 | 8/1966 | Dearden | 187/9 E |
| 3,289,869 | 12/1966 | Hoyt | 187/9 E |
| 3,841,442 | 10/1974 | Erickson et al. | 187/9 E |
| 3,889,782 | 6/1975 | Geis | 187/9 R |

FOREIGN PATENTS OR APPLICATIONS

| | | | |
|---|---|---|---|
| 764,982 | 1/1957 | United Kingdom | 187/9 |

*Primary Examiner*—Evon C. Blunk
*Assistant Examiner*—Jeffrey V. Nase
*Attorney, Agent, or Firm*—Oscar G. Pence

[57] ABSTRACT

An improved hoisting arrangement is provided for raising and lowering a load supporting carriage upon a front lift mast of an industrial lift truck which arrangement removes the normally vertically disposed carriage hoisting jack from between the upright channel members of the lift mast and positions such jack in a horizontal, rearwardly extending relation with respect to such lift mast so as to provide the lift truck operator with greater forward visibility.

2 Claims, 6 Drawing Figures

CARRIAGE HOISTING ARRANGEMENT FOR A LIFT TRUCK

BACKGROUND OF THE INVENTION

This invention relates generally to an industrial lift truck having a lift mast carried at its forward end and more particularly to an improved carriage hoisting arrangement for raising and lowering a load supporting carriage upon such lift mast, In the past, relatively large diameter hoist jacks and multi-chain structures mounted between the heavy upright channel members of the lift masts of prior art lift trucks have been utilized for raising and lowering the load supporting carriages of such trucks. Together with the limited width of the trucks, these structures combine to provide only relatively narrow slits through which the operator must see during operation. This lack of visibility greatly impairs operating efficiency.

OBJECTS OF THE INVENTION

Accordingly, an object of this invention is to provide an improved hoisting arrangement for raising and lowering the load supporting carriage upon a lift mast of an industrial lift truck which arrangement affords better forward visibility for the operator so as to enable more efficient operation of the lift truck.

Another object of this invention is to provide such improved forward visibility by relocating the hoist jack from its normal vertically disposed position beween the upright channel members of the lift mast to a horizontal position either above or below the operator's station so that a much more open "window" is provided between such channel members.

Another object of this invention is to provide such a hoisting arrangement which is adaptable for use with either a single or a multiple stage lift mast to accommodate different lift height requirements.

Other objects and advantages of the present invention will become more readily apparent upon reference to the accompanying drawings and following description.

DESCRIPTION OF THE PREFERRED EMBODIMENT

Figure 2:
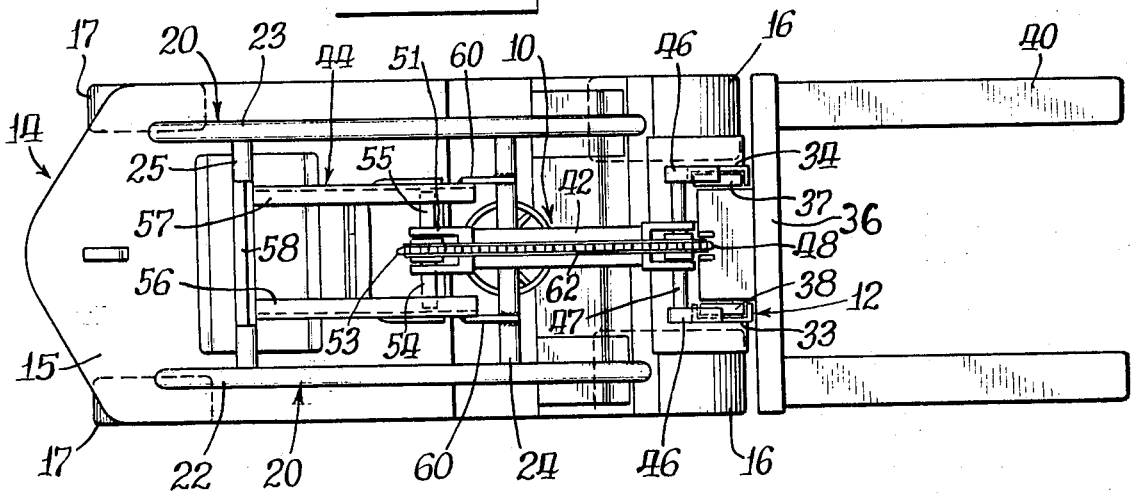
FIG. 2 is a top plan view of the lift truck and hoisting arrangement of FIG. 1.

Referring more particularly to the drawings, an improved load supporting carriage hoisting arrangement embodying the principles of the present invention is generally indicated at 10 for use in association with a lift mast assembly 12 of an industrial lift truck 14. The lift truck includes a chassis 15 which is supported for movement by a pair of powered front wheels 16 and a pair of steerable rear wheels 17. The lift truck also includes a generally centrally disposed, forwardly facing operator's station 19 and an operator protective structure 20 for providing overhead protection from falling objects and the like for the operator of the lift truck. The protective structure 20 includes a pair of generally inverted U-shaped support members 22 and 23 disposed in laterally spaced, longitudinally extending relation on the opposite sides of the operator's station with their front legs being connected to the front end of the chassis 15 and their rear legs being connected at the rear end of the chassis. The protective structure also includes a front spreader bar 24 and a rear spreader bar 25, which are disposed in transversely extending relation between the roll bars, as best shown in FIG. 2.

Figure 1:
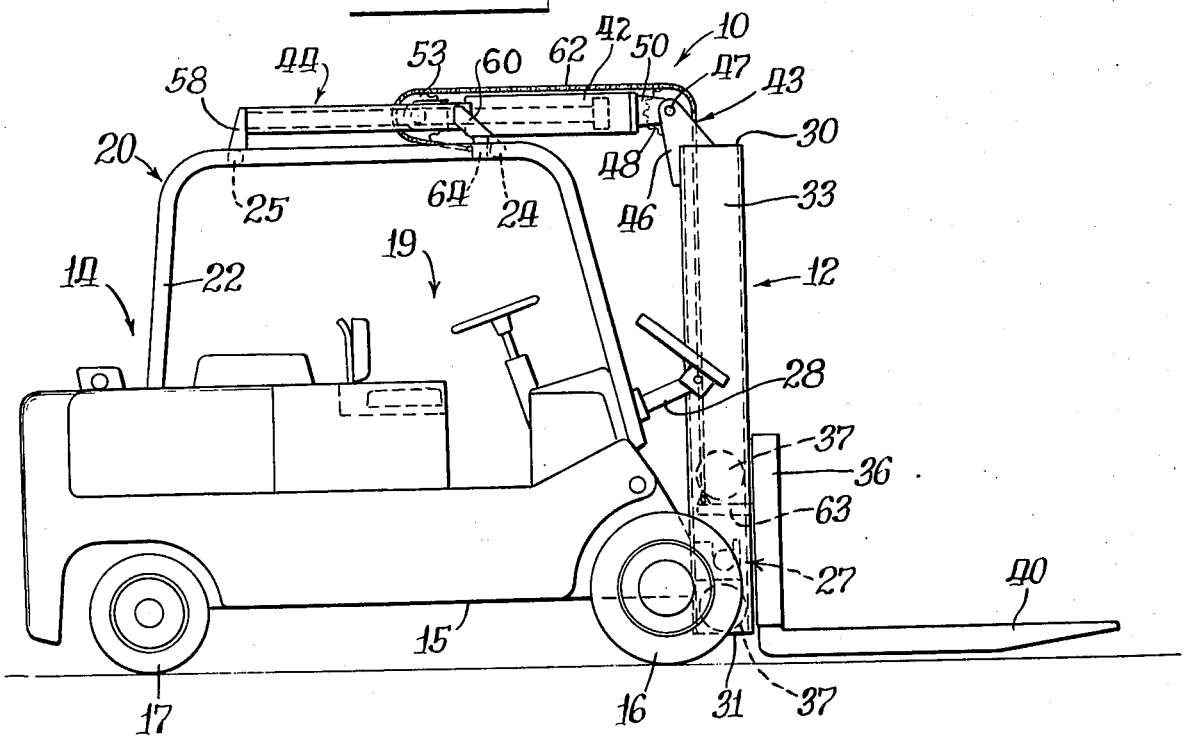
FIG. 1 is a side elevational view of a lift truck having a front lift mast and illustrating an improved hoisting arrangement associated therewith embodying the principles of the present invention.

The lift mast assembly 12 is mounted at the front end of the lift truck by a lower, transversely extending pivot connection at 27 and by a pair of tilt jacks, one of which is shown at 28 in FIG. 1. The tilt jacks are interconnected between the chassis 15 and the lift mast assembly substantially midway between its upper and lower ends 30 and 31, respectively, to enable the forward and rearward tilting of the mast assembly in a conventional manner. The mast assembly includes a pair of upright, laterally spaced channel members 33 and 34. The channel members are generally C-shaped and are disposed so as to open towards each other.

The mast assembly 12 also includes a load supporting carriage 36. The carriage has two pairs of transversely mounted rollers 37 and 38, with one roller of each pair being rollably mounted in a respective one of the channel members 33 and 34 of the mast assembly to mount the carriage for vertical movement along the mast assembly. The load carriage also includes cantilevered load supporting means, such as a pair of laterally spaced, longitudinal forwardly extending lift forks 40 or the like.

The hoisting arrangement 10 includes powered means or an extensible and retractable jack 42 and directional change means, such as a sheave and jack supporting assembly 43, and a jack supporting track 44 for mounting the jack 42 in horizontal, longitudinal rearwardly extending relation from one end of the mast assembly 12. The sheave and jack supporting assembly 43 includes a pair of upstanding brackets 46 which are individually secured to the upper ends of each of the channel members 33 and 34, respectively, and a spreader bar or shaft 47 extending transversely between such brackets. A sheave 48 is rotatably journalled on the bar midway between the brackets 46. The jack 42 is provided with a bifurcated bracket 50 at its head end for pivotally mounting the jack to the spreader bar 47 in alignment with the sheave 48. A bifurcated bracket 51 is also provided at the rod end of the jack for rotatably mounting a sheave 53 in alignment with sheave 48. The bracket 51 also rotatably mounts a pair of laterally spaced rollers 54 and 55 on the opposite sides of the sheave 53 for purposes hereinafter explained.

The jack supporting track 44 includes a pair of laterally spaced, C-shaped rails 56 and 57. The rails are mounted at a predetermined height substantially equal to the sheave 48 by a rear bracket 58 connected to the rear spreader bar 25 of the operator protective structure 20 and by a pair of front brackets 60 connected to the front spreader bar 24. The rollers 54 and 55 are individually rollably mounted within respective ones of the rails 56 and 57 so as to permit the fore and aft movement of the rod end of the jack 42 therealong.

Carriage propelling means, such as an elongated flexible member or chain 62 is provided and has one end thereof anchored to a mounting bracket 63 on the back side of the carriage 36. The chain extends upwardly therefrom and is reeved about the sheave 48 at the upper end of the lift mast and then rearwardly therefrom about the sheave 53 at the rod end of the jack 42. The opposite end of the chain 62 is anchored to a mounting bracket 64 secured to the front spreader bar 24 of the protective structure 20.

Operation

While the operation of the present invention is believed to be clearly apparent from the foregoing description, further amplification will be made in the following brief summary of such operation. In operation, when the jack 42 is in its retracted position, as shown in FIG. 1, the length of the chain 62 is sufficient to position the load carriage 36 at the lower end 31 of the lift mast assembly 12 so that the forks 40 are positionable on the ground. Upon extension of the jack, the chain is pulled rearwardly, thus being effective in raising the load carriage vertically along the mast due to the shortening of the length of the chain between the sheave 48 and the mounting bracket 63.

Figure 3:
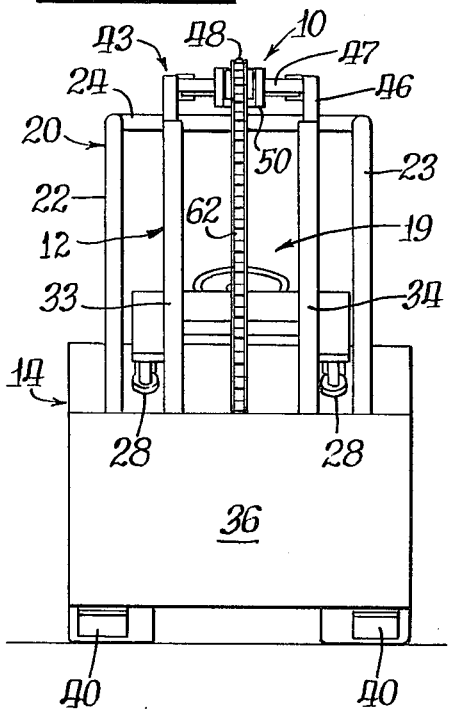
FIG. 3 is a front elevational view of the lift truck and hoisting arrangement of FIG. 1.

Because the chain is reeved about the sheave 53 and has its adjacent end anchored to the protective structure 20, a two-to-one movement ratio is provided between the jack and the carriage. Consequently, the vertical movement of the carriage is twice the horizontal movement of the jack, thus permitting the use of a relatively shorter jack than would otherwise be possible. As best shown in FIG. 3, the positioning of the jack above the operator's station 19 in the manner described, provides a much more open "window" through the lift mast so as to improve the forward visibility for the operator to enable greater operating efficiency.

Alternate Embodiments of the Present Invention

Figure 4:
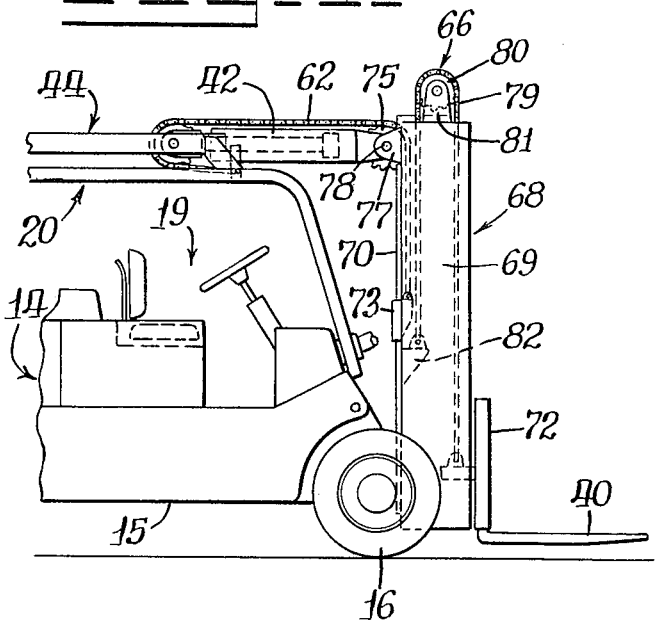
FIG. 4 is a partial side elevational view of the lift truck of FIG. 1, but having a two-stage lift mast, and illustrating a modification of the present hoisting arrangement for use with such two-stage lift mast.

A modification of the present invention is illustrated in FIG. 4, wherein an improved hoisting arrangement 66 which differs in certain respects to the hoisting arrangement 10 of the previous embodiment, is provided for use in association with a two-stage lift mast 68. It should be noted that components in this and the following embodiments of the present invention which are identical to those of the preceeding embodiments are depicted by like numerals, even though they may not be specifically described in the following brief descriptions of such embodiments, which will be directed primarily to the difrerences therebetween. The two-stage lift mast 68 has a stationary outer section 69 and a movable inner section 70 telescopically mounted in any suitable manner within the stationary section. A load carriage 72 which is similar to that previously described is mounted for vertical movement along the movable inner mast section 70.

The hoisting arrangement 66 has one end of the chain 62 anchored to the movable mast section by a bracket 73 at a position substantially midway between the upper and lower ends of such mast section, instead of being anchored to the load carriage as in the previous embodiment. The chain is then reeved about a sheave 75 which is journalled on a transverse spreader bar 78. The spreader bar is mounted to the back side of the stationary mast by a pair of brackets, one of which is shown at 77, which also mounts the head end of the jack 42.

The hoisting arrangement 66 also includes a second chain 79 having one end thereof anchored to the load carriage 72. Such chain extends upwardly therefrom and is reeved about a second sheave 80 mounted by a bracket 81 to the upper end of the inner movable mast section 70. The chain then extends downwardly therefrom and is anchored to the stationary outer mast by a bracket 82. Thus, when the jack 42 is extended, the first chain 62 effects the raising of the inner mast section within the stationary mast, while the second chain 79 effects the raising of the load carriage 72 due to the movement of the inner mast section. The inner mast section, as before, moves at a two-to-one ratio relative to the jack, while the load carriage 72 moves at a two-to-one ratio relative to the inner mast section. Consequently, a four-to-one ratio between the load carriage and the jack is thus provided so as to enable the load carriage to attain a greater height while utilizing a jack of substantially the same length as the previous embodiment.

Figure 5:
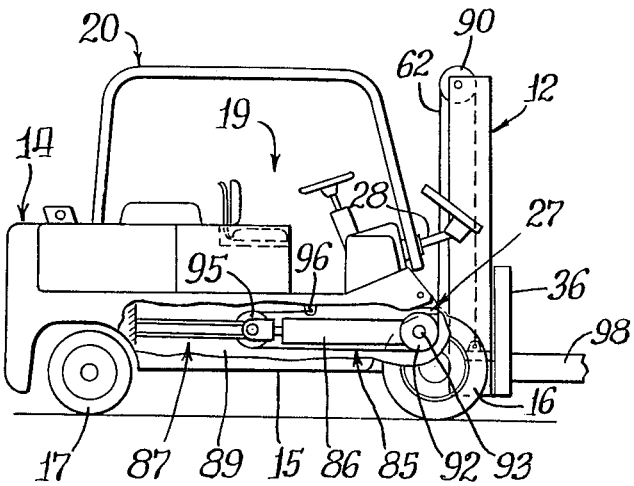
FIG. 5 is a side elevational view of a lift truck having a single stage lift mast and illustrating an alternate embodiment for the hoisting arrangement of the present invention which locates the hoist jack below the operator's station of such lift truck.

Referring now to FIG. 5, there is shown an alternate embodiment of the present invention wherein a hoisting arrangement 85 has a hoisting jack 86 supported by a track 87, which track is located within a cavity 89 formed in the chassis 15 of the lift truck 14 under its operator's station 19 instead of being supported therebove, as in the previous embodiment. Thus, in this embodiment, the chain 62 has its one end anchored to the load carriage 36, as before, and extends upwardly over a sheave 90 mounted at the upper end of the lift mast assembly 12 and then downwardly therefrom around a second sheave 92 mounted at the forward end of the cavity 89. Such sheave is mounted by a shaft 93 which also pivotally mounts the head end of the jack. Also, such shaft preferably provides the pivot connection 27 of FIG. 1 for mounting the lower end of the lift mast assembly to the chassis or else in axial alignment therewith. Thus, tilting of the lift mast by the tilt jacks 28 does not effect the height adjustment of the load carriage. From the second sheave 92, the chain extends rearwardly and is reeved about a third sheave 95 carried at the rod end of the jack 86. The opposite end of the chain is then anchored by a bracket 96 to the chassis. The rod end of the jack is similarly rollably mounted within the track 87 so as to guide its fore and aft movement upon the retraction and extension of the jack for raising and lowering the load carriage in the manner described before.

In this embodiment, the load carriage 36 is shown with a single, centrally mounted elongated tine 98, instead of the forks 40, for raising hollow cylindrical objects, such as coils of steel, rolls of carpeting, or the like, not shown.

Figure 6:
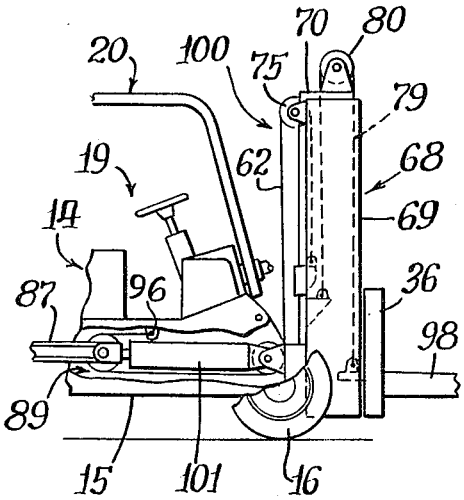
FIG. 6 illustrates a modification of the embodiment of FIG. 5 for use with a two-stage lift mast.

In the alternate embodiment of FIG. 6, a hoisting arrangement 100 is provided in which its jack 101 is mounted in the cavity 89, as in the embodiment of FIG. 5, but which is modified, as in the embodiment of FIG. 4 for use with the two-stage lift mast 68 thereof.

Thus, as is readily apparent from the foregoing, the particular constructions of the described embodimof the hoisting arrangements of the present invention are effective in removing the hoisting jack from between the channel members of a lift mast assembly, so as to provide greater visibility therethrough. While the invention has been described and shown with particular reference to such preferred embodiments, it will be apparent that variations might be possible that would fall within the scope of the present invention which is not intended to be limited except as defined in the following claims.

What is claimed is:

1. A hoisting arrangement for a lift truck having a chassis with a forwardly facing operator's station carried thereon and an operator protective structure disposed in overhead protective relation above said operator's station, comprising;

a mast assembly carried at the forward end of said truck and including a pair of upright, laterally spaced channel members;

a load supporting carriage mounted for vertical movement along said channel members;

jack supporting track means mounted atop said operator protective structure;

extensible and retractable jack means having opposite ends;

means pivotally mounting one end of said jack means in fixed relation relative to the upper end of said lift mast;

means for mounting the other end of said jack means for longitudinal movement along said track means so that said jack means is disposed in horizontal, rearwardly extending relation from the upper end of the lift mast;

first sheave means mounted at the upper end of said lift mast;

second sheave means carried on said other end of said jack means; and elongated chain means having one end thereof anchored to said load carriage and extending upwardly therefrom around said first sheave means, then rearwardly therefrom around said second sheave means and having its other end anchored relative to said jack supporting track means so that the extension of said jack means is effective in raising said load carriage while said jack means is positioned to permit greater visibility through said mast assembly.

2. In a lift truck, the combination comprising:

a wheel supported chassis having a front end;

an upright lift mast carried at the front end of the chassis and having an upper end;

a load supporting carriage mounted for vertical movement along said lift mast;

an operator station carried on the chassis in forwardly looking relation behind said lift mast;

an operator protective structure carried by the chassis and disposed in overhead protective relation above said operator station;

an extensible and retractable jack having opposite ends;

a support carried on the upper end of the lift mast for pivotally mounting one end of the jack in fixed relation thereto, said support having first sheave means rotatably mounted thereon;

a longitudinal track mounted atop said operator protective structure in rearwardly disposed relation to said first sheave means;

second sheave means carried on the other end of said jack and including roller means for supporting said other end of the jack for fore and aft movement along said track; and an elongated lift chain having opposite ends, with one end thereof being anchored to the load carriage, said chain extending upwardly therefrom and reeved about said first sheave means, then rearwardly about said second sheave means, and with its opposite end being anchored relative to said track.

* * * * *